US006988843B2

(12) United States Patent
Song

(10) Patent No.: US 6,988,843 B2
(45) Date of Patent: Jan. 24, 2006

(54) LOWER CUTTER FOR COMPACT PRINTER AND CUTTING DEVICE INCLUDING THE SAME

(75) Inventor: Jong-Weon Song, Gunpo-si (KR)

(73) Assignee: Bixolon Co., Ltd., (KR)

( * ) Notice: Subject to any disclaimer, the term of this patent is extended or adjusted under 35 U.S.C. 154(b) by 28 days.

(21) Appl. No.: 10/241,713

(22) Filed: Sep. 12, 2002

(65) Prior Publication Data

US 2003/0156882 A1 Aug. 21, 2003

(30) Foreign Application Priority Data

Feb. 15, 2002 (KR) ..... 2002-8138
Feb. 15, 2002 (KR) ..... 2002-8139
Feb. 15, 2002 (KR) ..... 2002-8140
May 31, 2002 (KR) ..... 2002-30744

(51) Int. Cl.
*B41J 11/70* (2006.01)

(52) U.S. Cl. ..... 400/621; 400/693; 83/872

(58) Field of Classification Search ..... 400/621–621.2, 400/508, 226, 693; B41J 11/70

See application file for complete search history.

(56) References Cited

U.S. PATENT DOCUMENTS 4,572,686 A * 2/1986 Tanaka ..... 400/621.1
5,105,703 A * 4/1992 Kondo ..... 83/636
5,727,889 A * 3/1998 Koyabu ..... 400/621
5,833,380 A * 11/1998 Hosomi et al. ..... 400/621
6,447,187 B1 * 9/2002 Robinson ..... 400/621
6,715,948 B2 * 4/2004 Morita et al. ..... 400/621

* cited by examiner

*Primary Examiner*—Ren Yan
*Assistant Examiner*—Marissa Ferguson
(74) *Attorney, Agent, or Firm*—Morgan Lewis & Bockius LLP

(57) ABSTRACT

A lower cutter for a compact printer and a cutting device including the lower cutter for preventing a jam phenomenon of a paper and reducing production cost is disclosed. The cutting device includes a hinge plate attached to an upper surface of the lower cutter, a plurality of biasing elements disposed under the lower cutter for affording biasing force to the lower cutter, a base member for allowing the biasing elements to be seated thereon and the hinge plate to be hingedly coupled thereto, a carriage for rotatably supporting the upper cutter partially overlapped on the lower cutter and for laterally moving the upper cutter, and an upper case and a lower case for housing driving means for the carriage and the upper cutter.

9 Claims, 8 Drawing Sheets

LOWER CUTTER FOR COMPACT PRINTER AND CUTTING DEVICE INCLUDING THE SAME

BACKGROUND OF THE INVENTION

1. Field of the Invention

The present invention relates to a lower cutter for a compact printer and a cutting device including the same, and more particularly to a lower cutter for a compact printer and a cutting device including the same, in which the lower cutter includes a cutting blade having a reduced area engaged to an upper cutter and is adapted to be elastically displaced, thereby preventing a jam phenomenon of a paper and reducing a size of a lower cutter.

2. Description of the Prior Art

In general, a compact printer is commonly used in printing a paper supplied from a rolled paper of a certain width to create a itemized receipt etc. in a dot printing manner or an ink-jet printing manner and issuing the printed itemized receipt etc.

Such compact printers can be classified into a scissors type, a guillotine type and a rotary type according to a shape of a cutter.

FIG. 1 shows a conventional compact printer in perspective, in which a shutter member is opened. As shown in the drawing, a conventional compact printer 1 includes an upper cutter disposed at a clamshell-shaped cover 1—1, and a lower cutter disposed at a printer body 102. The upper cutter 10 is laterally operated from a side of a printed paper to an opposite side to sever the printed paper "P" discharged from the printer body 1-2 while being in close contact with the lower cutters 20.

FIGS. 2 and 3 are cross-sectional views showing the relation of an upper cutter and a lower cutter of the conventional compact printer. As shown in the drawings, the upper cutter 10 is a rotary type auto cutter, which is adapted to be rotated by drive means and supported by a carriage 3. The carriage 3 is provided at its side with a driving gear coupled to an end of a rotating shaft "H". The rotating shaft "H" is coupled at the other end to the upper cutter of a certain diameter. The rotating shaft "H" is also provided between the carriage 3 and the upper cutter 10 with elastic means "S" inserted thereon.

The carriage 3 is housed in a case 4. The case 4 is provided at its front and upper portion with a shutter member 5, which is rotatably supported at one end by a hinge pin "h".

The shutter member 5 is adapted to shield the case 4 and the upper cutter 10 to prevent a printed paper from entering the case 4 during a cutting operation.

The lower cutter 20 is attached to the printer body 1-2. More specifically, the lower cutter 20 is mounted at a predetermined position on a fixing member 2 such that the lower cutter 20 is partially overlapped with the upper cutter 10 while being in contact with the upper cutter 10.

In the conventional compact printer, the upper cover 1—1 is hingedly installed on the printer body 1-2. When the upper cover 1—1 is closed, the upper cutter 10 is partially overlapped with and engaged to the stationary lower cutter 20 fixed to the printer body 1-2. As the upper cutter 10 is laterally moved while being rotated, the upper cutter 10 gradually intersects with a cutting blade 20-1 of the lower cutter 20 to cut a printed paper disposed therebetween.

The lower cutter 20 is made of a metal plate of a predetermined thickness, and attached to the fixing member 2 separately mounted on the printer body 1-2. The rotary type upper cutter 10 intersects at its peripheral portion with the lower cutter 10 from side to side to sever a printed paper discharged therefrom at a predetermined length.

The upper cover is embodied into a clamshell shape and hingedly coupled to a side of the printer body by a hinge pin (not shown). When the upper cover is closed and locked to the printer body, the upper and lower cutters are disposed as shown in FIGS. 2 and 3.

FIG. 2 is a view showing an overlapped width "L1" of the upper and lower cutters before the upper cover is locked to the printer body, and FIG. 3 is a view showing an overlapped width "L2" of the upper and lower cutters when the upper cutter is fully locked to the printer body.

In the clamshell type upper cover, where a hinge point of the upper cover is set to be higher than the upper cover, a space required for opening and closing of the upper cutter is small, thereby causing replacement of a printing paper to be troublesome. On the contrary, where a hinge point of the upper cover is lower than the upper cutter, an overlapped width of the upper and lower cutters is not sufficient so that the upper cutter passes over the lower cutter.

On this account, in a clamshell type compact printer, an overlapped width of the upper and lower cutters 10 and 20 is closely related to a hinge point of the upper cover. Although it is preferable that an overlapped width of the upper and lower cutters is set to be "L1" as indicated in FIG. 2, the overlapped width "L2" must be accepted in the case of the clamshell type, in which a cover swings to be opened and closed. Hence, a contact surface between a printed paper and an upper cutter becomes large, causing quality of a cut paper to be deteriorated.

The upper cutter 10 is engaged with a cutting blade of the lower cutter 20 when the upper cover 1—1 is closed relative to the printer body 1-2. Then, as the upper cutter 10 is laterally moved while being rotated, its edge gradually intersects a cutting blade of the lower cutter 20 from side to side to cut a printed paper disposed therebetween.

Accordingly, an cutting blade of an upper surface of the lower cutter serving to cut a paper by cooperation of the upper cutter requires periodic maintenance for retaining its precision. That is, since the lower cutter is worn in its upper surface as a printer is used for a long time, cutting performance of the lower cutter is deteriorated according to degree of wear.

Such wear of the lower cutter may cause an outputted and discharged printing paper to have an irregularly cut line, and may cause a jam phenomenon at the cutting blade.

On this account, although the lower cutter must be precisely ground at an upper surface being in contact with the upper cutter, there is a limit to reduction of a thickness or a size of the lower cutter because of deformation due to a grinding or a heat treatment. In other words, it is further difficult to reduce an overall size of the lower cutter.

As a result, there is an economic drawback in that a used lower cutter must be frequently replaced with a new one.

When the upper cutter 10 is overlapped on the lower cutter 20, the upper cutter 10 is biased toward the lower cutter 20 by elastic means "S" inserted on a rotating shaft "H" between a carriage 3 and the upper cutter 10. A printed paper "P", which is discharged from the printer, is cut by lateral movement of the upper cutter 10 as well as rotation of the upper cutter 10 caused by the driving gear "G". A paper end under the cut line does not pass between the upper cutter and the lower cutter but is bent and penetrates under the upper cutter 10 when the paper is further discharged.

To this end, there is a necessity for assuring an ejecting path for a printing paper, thereby requiring another structure for defining an ejecting path. Therefore, there is a limit to reducing the upper cutter to a predetermined size or less.

The printing paper is supplied as a rolled paper, and is gradually reduced in its roll diameter during progress of printing. Owing to the small diameter of the rolled paper, the paper supplied from the rolled paper must be curled or curved, thereby causing a jam phenomenon of the curved paper.

When the upper cutter laterally moves from side to side relative the lower cutter to cut a printing paper, the shutter member 5 is swung about the hinge pin "h" to prevent a jam phenomenon of a printing paper. Therefore, there is also a limit to reducing an overall size of the cutting device due to an operating radius of the shutter member.

SUMMARY OF THE INVENTION

Accordingly, the present invention has been made keeping in mind the above problems occurring in the prior art, and an object of the present invention is to provide a lower cutter for a compact printer and a cutting device including the lower cutter which is intended to prevent a jam phenomenon of a paper and to reduce size of the cutter by allowing the lower cutter to be elastically displaced relative to an upper cutter.

Another object of the present invention is to provide a lower cutter for a compact printer and a cutting device including the lower cutter which is intended to allow an upper cutter to be stably seated on the lower cutter when an upper cover is locked to a printer body, and improve a cut line of a printing paper by minimizing a width of a cutting blade of the lower cutter to be engaged to the upper cutter.

A further object of the present invention is to provide a lower cutter for a compact printer and a cutting device including the lower cutter which is intended to achieve prevention of deformation of the lower cutter and extension of service life by improving a structure of a cutting blade of the lower cutter.

In order to accomplish the above object, the present invention provides a lower cutter for a compact printer which is adapted to intersect with a rotary type upper cutter housed in a cover to cut a printing paper, the lower cutter comprising: a hinge plate to which the lower cutter is attached at its upper surface; biasing means disposed under the lower cutter for providing biasing force to the lower cutter; and a base member on which the biasing means is seated.

The present invention also provides a lower cutter for a compact printer which is adapted to intersect with a rotary type upper cutter housed in a cover to cut a printing paper, the lower cutter comprising: a seating protrusion formed at its longitudinal cutting blade, on which the upper cutter is seated.

Furthermore, the present invention provides a cutting device for a compact printer, comprising: a lower cutter mounted on a printer body; an upper cutter installed in a cover swingably attached to the printer body and seated on the lower cutter; a hinge plate to which the lower cutter is attached at its upper surface; biasing means disposed under the lower cutter for providing biasing force to the lower cutter; a base member on which the biasing means is seated and to which the hinge plate is swingably attached, the base member being mounted on the printer body; a carriage for holding the upper cutter; and driving means for moving the carriage laterally.

The present invention also provides a cutting device for a compact printer, comprising: a rotary type upper cutter mounted in a cover of the compact printer to be laterally moved and to be rotated by driving means; and a lower-cutter fixedly mounted on a printer body and positioned to be substantially perpendicular to the upper cutter to cut a printing paper in a state of being in close contact with the upper cutter.

In addition, the present invention provides a cutting device for a compact printer comprising: a rotary type upper cutter mounted on an end of a cover and adapted to be laterally moved; and a lower cutter mounted on a printer body and bent along a longitudinal side to form a cutting blade to be engaged to the upper cutter.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

This invention will be described in further detail by way of example with reference to the accompanying drawings.

Figure 1:
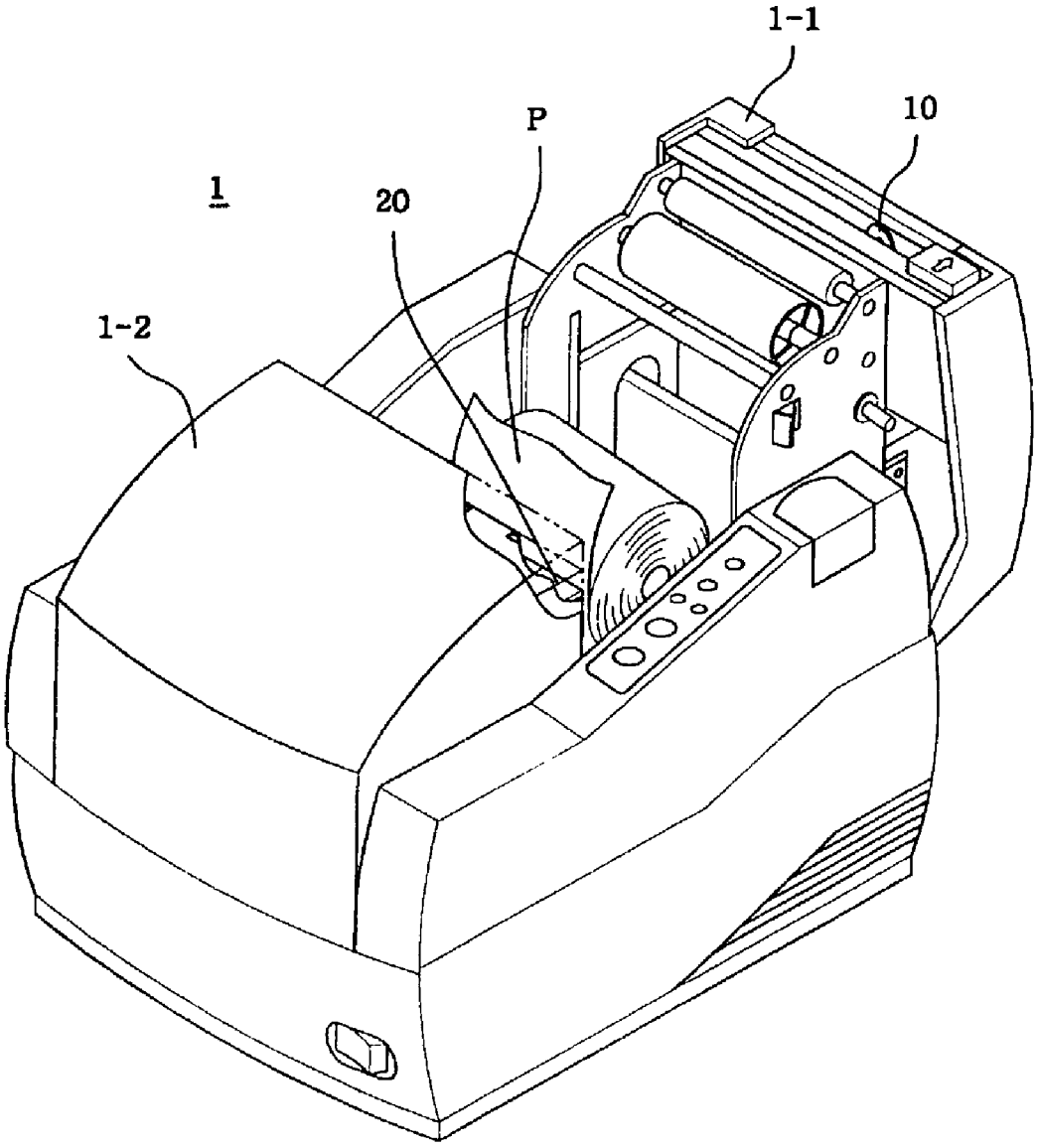
Fig. 1 Prior Art
FIG. 1 is a perspective view showing a conventional compact printer.
Figure 2:
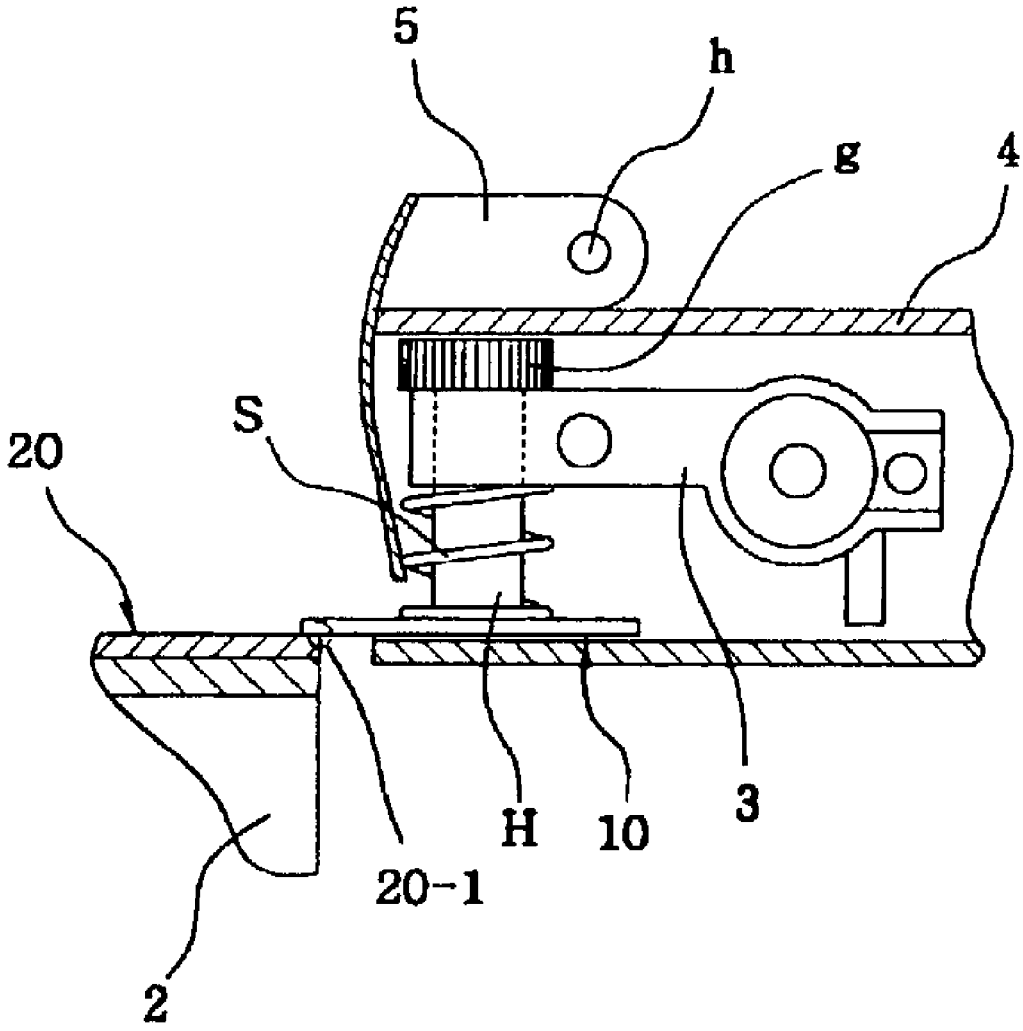
Fig. 2 Prior Art
FIGS. 2 and 3 are cross-sectional views showing positional relations of an upper cutter and a lower cutter of a conventional compact printer.
Figure 3:
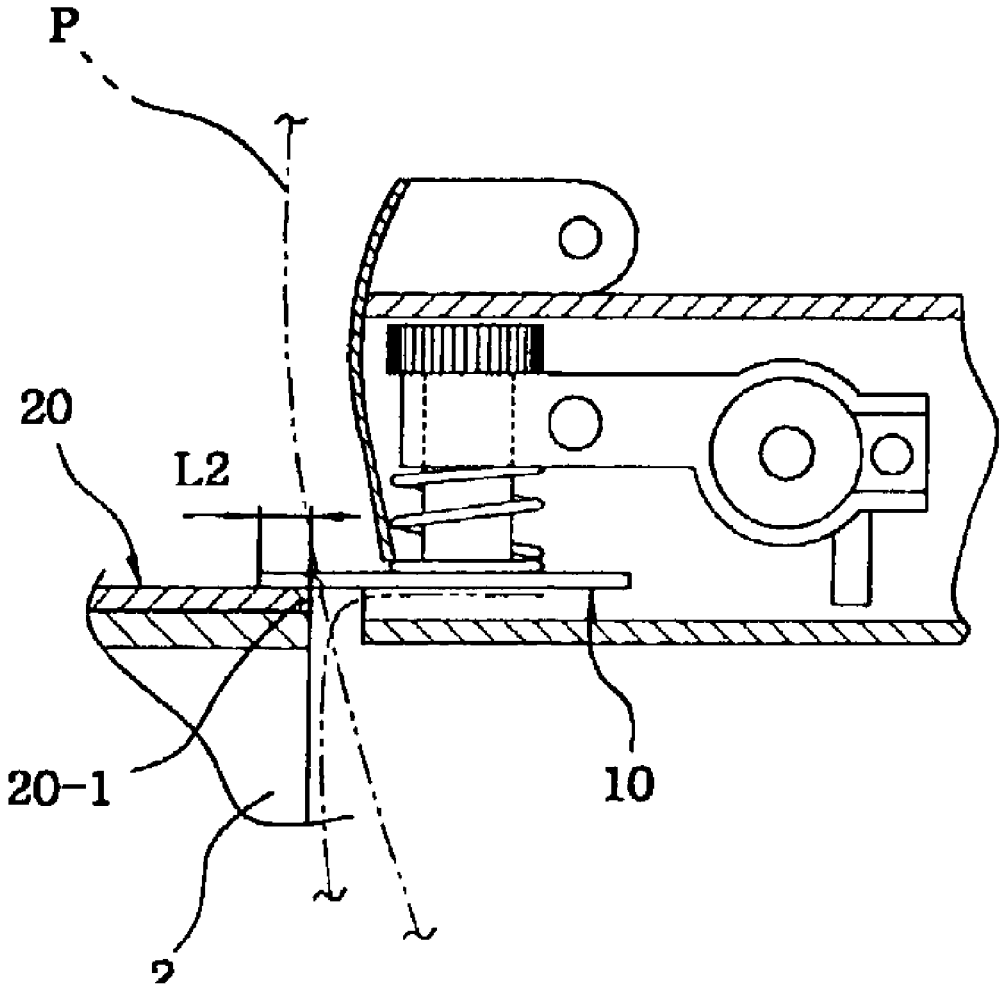
Fig. 3 Prior Art
Figure 4:
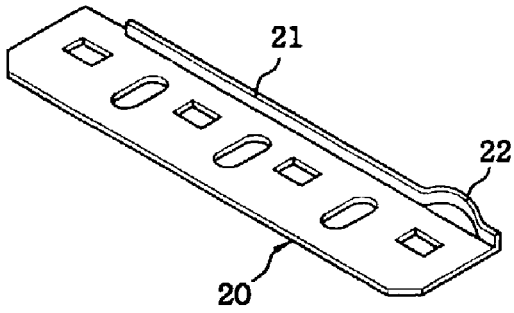
FIG. 4 is a perspective view showing a lower cutter according to the present invention.
Figure 5:
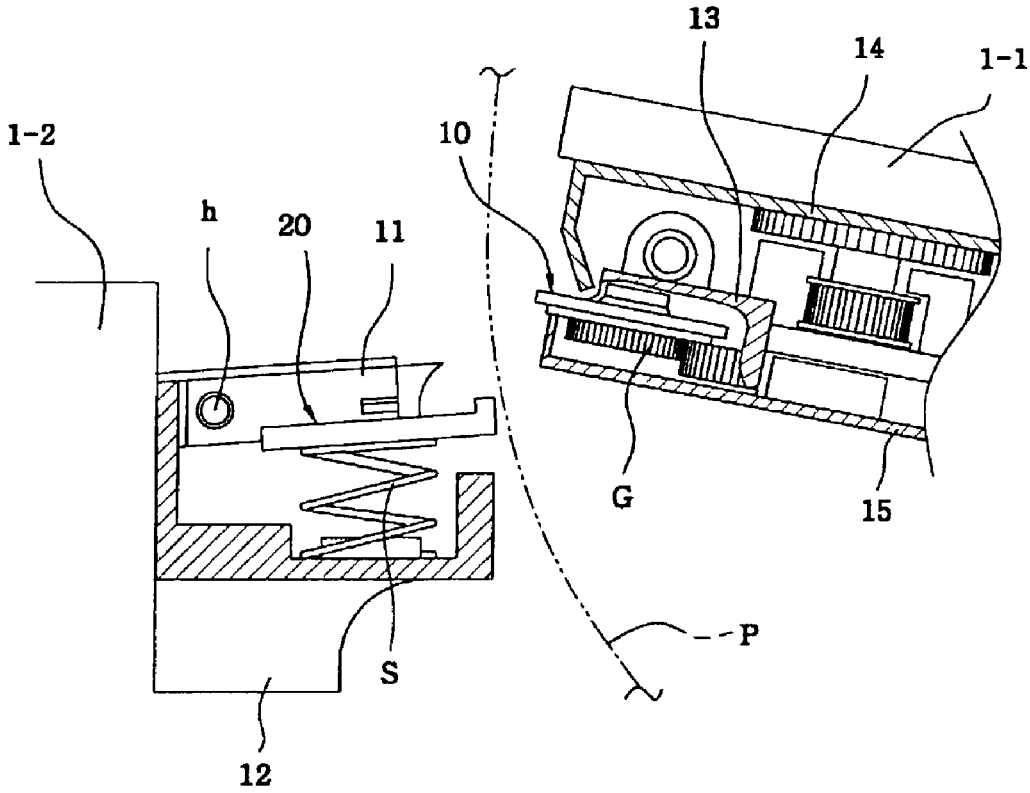
FIGS. 5 and 6 are cross-sectional views showing positional relations of an upper cutter and a lower cutter according to the present invention.
Figure 6:
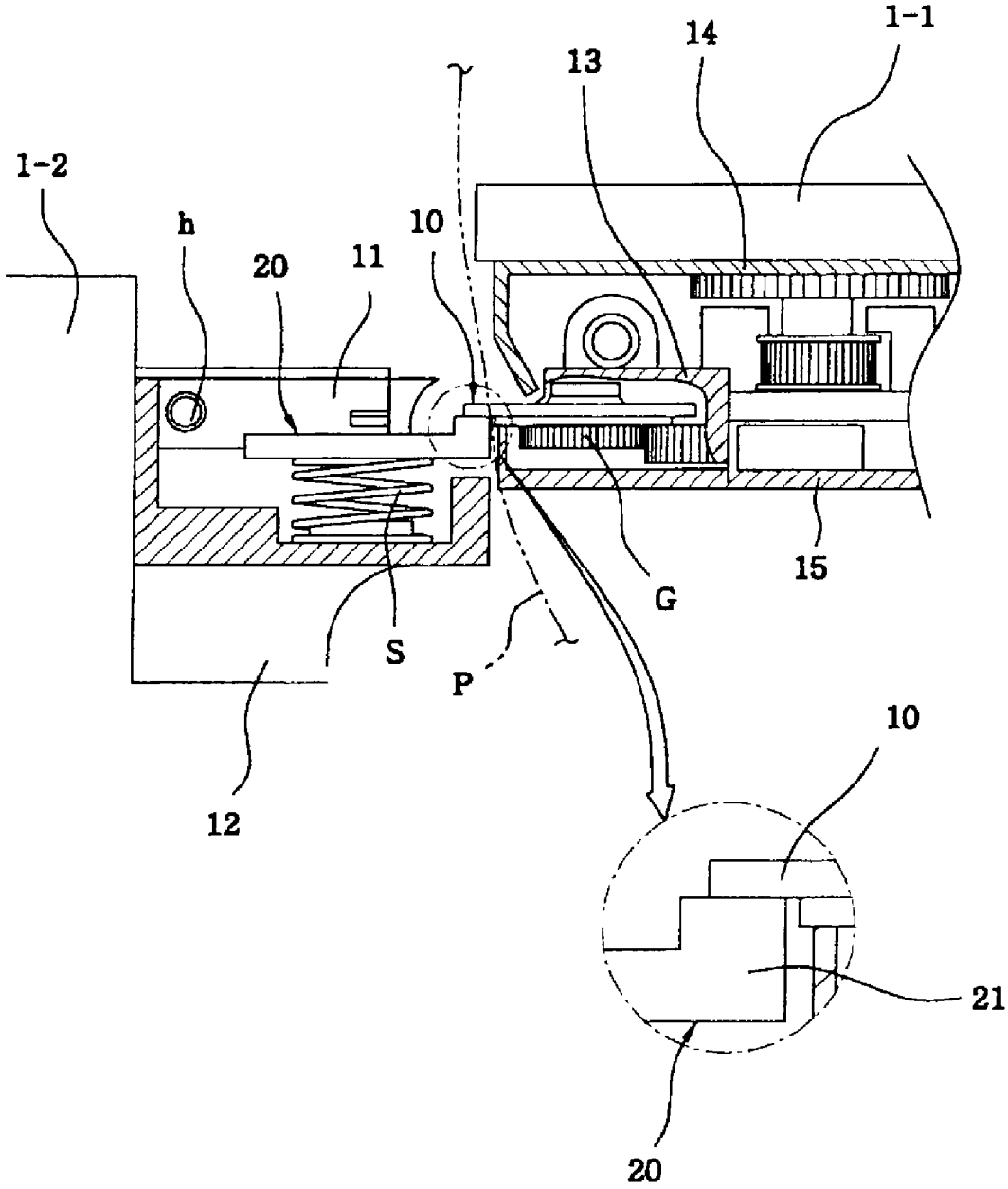

FIGS. 5 and 6 are cross-sectional views showing a positional relation of an upper cutter relative to a lower cutter.

A cutting device according to the present invention is adapted to cut a printing paper by intersection of a lower cutter 20 and a rotary type upper cutter 10 mounted on a cover 1—1 installed at a printer body 1-2.

The cutting device includes a hinge plate 11 attached to an upper surface of the lower cutter 20, a plurality of biasing elements "S" disposed under the lower cutter 20 for affording biasing force to the lower cutter 20, a base member 12 for allowing the biasing elements "S" to be seated thereon and the hinge plate 11 to be hingedly coupled thereto, a carriage 13 for rotatably supporting the upper cutter 10 partially overlapped on the lower cutter 20 and for laterally moving the upper cutter 10, and an upper case 14 and a lower case 15 for housing driving means for the carriage 13 and the upper cutter 10.

The hinge plate 11 to which the lower cutter 20 is attached is provided at its both sides with hinge pins "h", and is coupled to an upper portion of the base member 12 by its hinge pins "h". The hinge plate 11 is positioned together with the lower cutter 20 at a certain inclined angle by the biasing elements "S".

The upper cutter 10 is mounted on a common shaft of the carriage 13 together with a driving gear "G". The carriage 13 containing the upper cutter 10 therein is laterally moved from side to side by driving means.

The upper and lower cases 14 and 15 are bent at front portions thereof toward the upper cutter 10 except a moving section of the upper cutter 10, and assembled to each other.

In other words, the upper and lower cases 14 and 15 are assembled into a closed box shape except a moving section, within which a protruded portion of the upper cutter 10 is moved.

The lower cutter 20 is provided at its side with an arc-shaped seating protrusion 22 for allowing the upper cutter 10 to be seated thereon, and a cutting blade 21 longitudinally extended from the seating protrusion 22.

The seating protrusion 22 is protruded to have an arc shape. The seating protrusion 22 is preferably configured to have a dimension corresponding to a width by which a front end of the upper cutter 10 is overlapped inwardly from a front end of the lower cutter 20.

That is, the lower cutter 20 is configured such that the its seating protrusion 22 has an overlapped width "L1" and its cutting blade 21 extended from the seating protrusion 22 has an overlapped width "L2".

The biasing elements "S" may be embodied by leaf springs or coil-shaped compression springs, and are adapted to elastically support the hinge plate 11 including the lower cutter 20.

Figure 8:
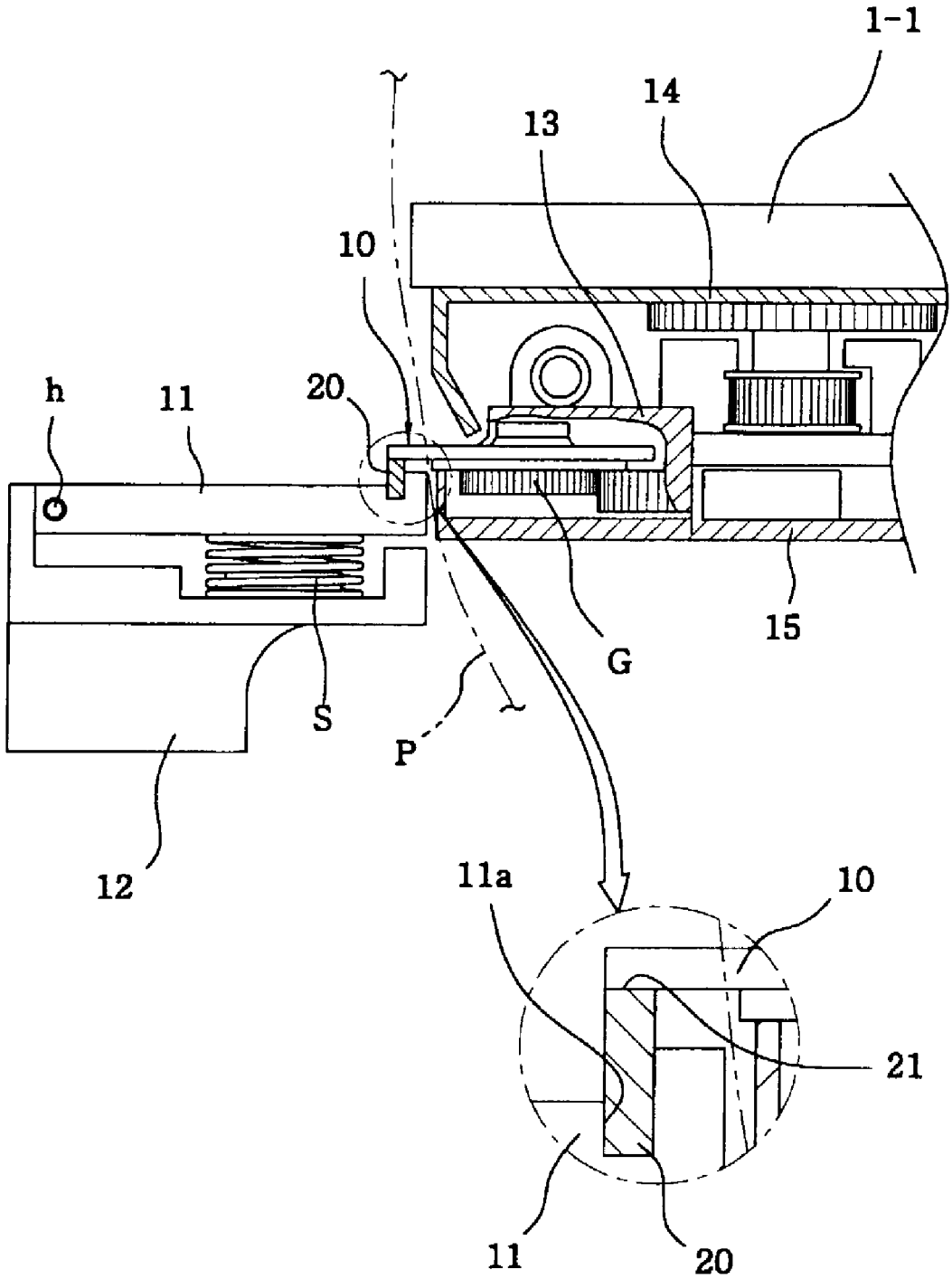
FIG. 8 is a cross-sectional view showing a compact printer according to another embodiment of the present invention, in which a lower cutter is positioned to be perpendicular to an upper cutter.
Figure 9:
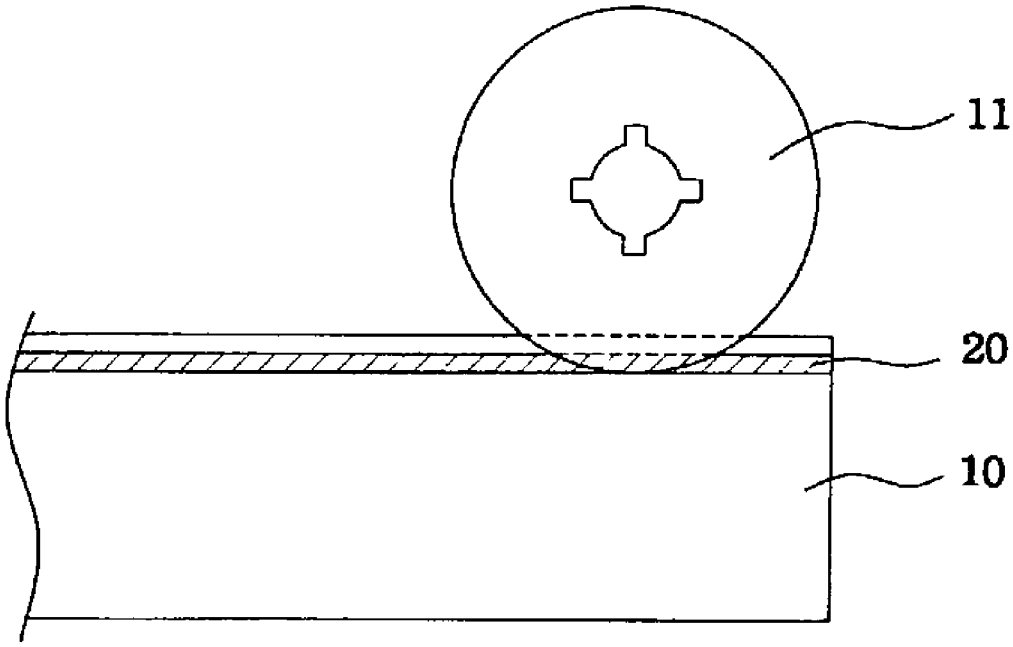
FIG. 9 is a plan view showing the upper cutter engaged to the lower cutter of FIG. 8.

Referring to FIGS. 8 and 9, there is shown a cutting device according to another embodiment of the present invention. As shown in the drawings, the cutting device comprises a rotary type upper cutter 10 mounted in a cover 1—1 to be laterally moved and to be rotated by driving means, and a lower cutter 20 fixedly mounted on a printer body 1-2 and positioned to be substantially perpendicular to the upper cutter 10 to cut a printing paper in a state of being in close contact with the upper cutter 10.

The lower cutter 20 is comprised of a strip-shaped plate having a rectangular section and a certain thickness. The lower cutter 20 is preferably subjected to a heat treatment at its upper surface to be engaged to the upper cutter 10.

The upper cutter 10 is a rotary type cutter, which is connected to the driving means, and the lower cutter 20, which is positioned to be perpendicular to the upper cutter 10, is coupled to a base member 12 mounted on the printer body 1-2.

The lower cutter 20 is vertically attached to a hinge plate 11, which is biasedly supported at its one end on the base member 12 by a biasing element "S". The hinge plate 11 is formed with a fixing groove 11*a*, which is extended longitudinally, so that the lower cutter 20 is fixedly inserted into the fixing groove 11*a* of the hinge plate 11.

The attachment of the lower cutter 20 to the fixing groove 11*a* can be also achieved by additional adhesives and screws.

As described above, the lower cutter 20 is coupled to the base member 12 via the hinge plate 11, and the base member 12 is usually mounted on the printer body 1-2.

The upper cutter 10, which is in contact with the lower cutter at its lower side surface, is mounted on a carriage 13 adapted to be laterally moved. The carriage 13 can be laterally moved together with the upper cutter 10 by the driving means.

Alternatively, the cutting device according to the present invention may comprise a rotary type upper cutter 10 mounted in a front end of a cover 1—1 to be laterally moved, and a lower cutter 20 mounted on a printer body 1-2 and bent upwardly at its cutting end to have a cutting blade surface 21 to be engaged to the upper cutter 10.

In this embodiment, the cutting end of the lower cutter 20, which has the cutting blade surface 21 to be in contact with the upper cutter 10, is bent upwardly, so that the cutting blade surface 21 faces upwardly. A width of the cutting blade surface 21 relies on a thickness of the lower cutter 20.

In still another embodiment of the present invention, the cutting device comprises a rotary type upper cutter 10 mounted in a front end of a cover 1—1 to be laterally moved, a lower cutter 20 bent upwardly at a right angle at its cutting end to have a cutting blade surface 21 to be engaged to the upper cutter 10 and provided at its cutting end with an arc-shaped seating protrusion on which the upper cutter 10 is seated, and biasing elements "S" disposed under the lower cutter 20.

The biasing elements "S" may be embodied by leaf springs or coil-shaped compression springs, and are adapted to elastically support the hinge plate 11 including the lower cutter 20, like the above embodiment.

Functions and effects of the lower cutter for a compact printer and the cutting device including the lower cutter will now be described.

FIG. 5 shows the cutting device according to the present invention, in which the upper cover is about to be locked to the printer body 1-2, and FIG. 6 shows the cutting device according to present invention, in which the upper cutter 10 is overlapped with the lower cutter 20 by a width "L2".

When the upper cutter 10 is partially seated on the seating protrusion 22 of the lower cutter 20, the upper cutter 10 is stably supported on the seating protrusion 22 by its large overlapped area so that the upper cutter 10 cannot pass over the lower cutter 20.

The upper cutter 10 is projected from a plane defined between front faces of the upper and lower cases 14 and 15, and is internally joined to the carriage 13. The upper cutter 10 is laterally moved from side to side by the driving means while being overlapped on and engaged to the lower cutter 20, so that a printing paper "P" is cut by the moving upper cutter 10. At this point, the lower cutter 20 and thus the hinge plate 11 are elastically supported in a predetermined inclined angle by the biasing elements "S" seated on the base member 12.

When the upper cutter 10 is seated on the seating protrusion 22 of the lower cutter 20, the upper cutter 10 is positioned adjacent to a printing paper. The printed and ejected paper "P" is cut by lateral movement of the upper cutter 10 responding to a signal from the printer in a state of being partially supported by the lower cutter.

From the seating protrusion 22, the upper cutter 10 starts to move laterally along the cutting blade 21 of the lower cutter 20 while being in contact with the cutting blade 21. In other words, the upper cutter 10 is laterally moved while being rotated about its axis during a cutting operation.

Figure 7:
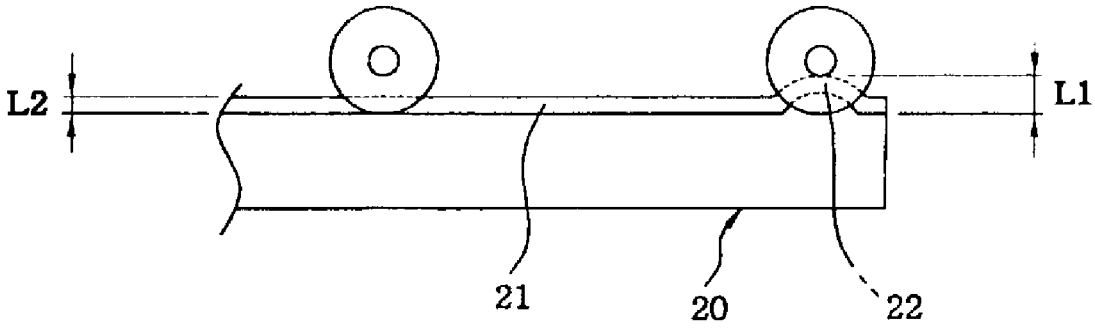
FIG. 7 is a plan view showing an upper cutter moving on a lower cutter while being engaged thereto.

As shown in FIG. 7, since a width "L1" when the upper cutter 10 is overlapped with the seating protrusion 22 of the lower cutter 20 is larger than a width "L2" when the upper cutter 10 is overlapped with the cutting blade 21 of the lower cutter 20, the cutting device is able to fulfill an ideal cutting operation.

In this case, since the cutting blade 21 of the lower cutter 20, to which the upper cutter 10 is engaged, is bent and extended somewhat upward, the lower cutter 20 can have a service life longer than that of a conventional lower cutter having a simple plate shape.

More specifically, as the upper cutter 10 is laterally moved and rotated while being engaged to the lower cutter 20, the cutting blade 21 of the lower cutter 20 is gradually worn away. However, since the end of the lower cutter 20 is bent and extended upward and the cutting blade 21 is formed on the end of the extended portion, a time required for complete wearing of the lower cutter is considerably longer than that of a conventional lower cutter. Furthermore, since the upper cutter 10 is laterally moved and rotated while being engaged to the cutting blade surface of the lower cutter, a cutting surface of the cutting blade is continually ground by the side surface of the upper cutter, thereby affording a new cutting blade face. Hence, a printing paper can be neatly cut by the continually regenerated cutting blade face of the lower cutter.

In addition, since the cutting blade 21 of the lower cutter 20 is bent upwardly at a right angle so that an area of the lower cutter engaged with the upper cutter 10 is considerably reduced, a jam phenomenon in which a printing paper is pinched between the upper and lower cutters can be eliminated, thereby improving cutting efficiency.

In addition, by reduction of the engaging area with the upper cutter, a worn area of the lower cutter is reduced. Since the engaging area, i.e., the worn area of the lower cutter is reduced, it is possible to reduce thermal deformation of the upper and lower cutters. Therefore, deformation of the lower cutter due to use for a long time can be prevented while cutting efficiency can be improved.

As a result, according to the cutting device of the present invention, a printing paper is more neatly cut relative to a conventional cutting device, and thus cutting efficiency is improved.

Furthermore, since there is no limit to positioning of a hinge point in a clamshell type compact printer, the cutting device of the present invention can afford structural convenience.

Referring again to drawings, the lower cutter 20 is attached to the hinge plate 11, and is fixedly mounted on the printer body 1-2 via the base member 12. The hinge plate 11 is positioned at a certain inclination by the biasing elements "S" engaged to the lower cutter 20. The upper cover 1—1 is prepared by assembly of the upper case 14 and the lower case 15. The upper cutter 10 mounted on the carriage 13, which is laterally moved by the driving means (not shown), is seated on the lower cutter 20 when the upper cover 1—1 is locked to the printer body 1-2 (see FIG. 5).

As the upper cutter 10 is seated on the lower cutter 20 by the locking of the upper cover 1—1, the lower cutter 20 is swung downward together with the hinge plate 11 holding the lower cutter 20 about the hinge pins "h" so that the biasing elements "S" are compressed between the lower cutter 20 and the base member 12.

A printed and ejected paper "P" is cut at a predetermined location by rotation of the upper cutter 10 and lateral movement of the carriage 13. After the cutting operation, a free end of the subsequent paper "P" can be passed between the upper cutter 10 and the lower cutter 20 without any difficulty.

The easy passage of the paper results from the fact that the upper case 14 and the lower case 15 are bent at front faces thereof to form an integral box shape except an area required for movement of the upper cutter 10. A rolled paper is unwound and discharged outward through a gap between the upper and lower cutters.

According to the present invention, there is an advantage in that a jam phenomenon can be prevented without increase of size of the upper cutter, as opposed to a conventional cutting device in which a printing paper is bent rearward and passes along a lower surface of the upper cutter, thereby causing a jam phenomenon. In addition, since it is not necessary to provide a shutter member for preventing a jam phenomenon of a paper, component production cost can be reduced.

In the embodiment shown in FIGS. 8 and 9, the lower cutter 20 is vertically inserted into the fixing groove 11*a* of the hinge plate 11 such that the cutting blade surface 21 of the lower cutter 20 is in contact with a lower side of the upper cutter 10. In this state, as the upper cutter 10 is laterally moved, a printing paper "P" is cut. The hinge plate 11 including the lower cutter 20 is elastically supported by the biasing elements "S" disposed between the hinge plate 11 and the base member 12.

According to this embodiment, even though the cutting blade surface 21 of the lower cutter 20, which is vertically fixed to the hinge plate 11, is considerably worn away depending on conditions of the upper cutter 10, it is possible to prevent local wearing and thus frequent replacement of the lower cutter 20 since the cutting blade surface 21 is evenly worn away owing to the vertical position of the lower cutter 20. In other words, a service life of the lower cutter 20 can be remarkably extended.

Furthermore, a service life of the lower cutter 20 can be considerably extended as compared to a conventional plate-shaped lower cutter, due to a thickness of the cutting blade surface 21 of the lower cutter 20.

Accordingly, since the cutting blade surface 21 of the lower cutter 20 can be continually regenerated as the cutting blade surface is worn away, the lower cutter 20 enables printing papers to be neatly cut.

As described above, the present invention provides a cutting device for a compact printer in which a lower cutter is bent upward at its cutting blade and is formed at an initial seating location with a seating protrusion, on which an upper cutter is overlapped, such that an overlapped area of the upper and lower cases is largest at the seating protrusion of the lower cutter and is smallest at the remaining cutting blade portion. Therefore, as the cutting blade of the lower cutter is worn away, the cutting blade face is regenerated, thereby enabling extension of service life of the lower cutter and economic savings. Furthermore, since an overlapped area of the upper and lower cutters is relatively small, cutting efficiency for a paper is improved.

In addition, since upper and lower cases of the cutting device are bent at front faces thereof to form a simple box shape having an opening in which the upper cutter is laterally moved, a printed paper can pass through a gap between the upper and lower cutters without a jam phenomenon of a paper. In addition, since a conventional shutter member is not necessary, it is possible to reduce production cost and to reduce size of a cutter.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cutting mechanism for a compact printer, said cutting mechanism having a rotary type upper cutter and a lower cutter, said lower cutter having a seating protrusion formed at its longitudinal cutting blade and, said upper cutter is housed in a cover to cut a printing paper wherein said upper cutter is adapted to intersect and sit on the protrusion of the lower cutter without overlapping the lower cutter.

2. The cutting mechanism as set forth in claim 1, in which the seating protrusion is shaped to have a arc-shaped protrusion.

3. The cutting mechanism as set forth in claim 1 or 2, in which the seating protrusion is projected by a width at which upper and lower covers are overlapped when the cover is locked to a printer body.

4. A cutting device for a compact printer, comprising:

a rotary type upper cutter mounted in a cover of the compact printer to be laterally moved and to be rotated by driving means; and a lower cutter fixedly mounted on a printer body and positioned to be substantially perpendicular to the upper cutter to cut a printing paper in a state of being in close contact with the upper cutter.

5. The cutting device as set forth in claim 4, in which the lower cutter is comprised of a strip-shaped plate having a rectangular section.

6. A cutting device for a compact printer comprising:

a rotary type upper cutter mounted on an end of a cover and adapted to be laterally moved; and a lower cutter mounted on a printer body and bent along a longitudinal side to form a cutting blade to be engaged to the upper cutter.

7. The cutting device as set forth in claim 6, in which the lower cutter is bent upwardly at a right angle to form the cutting blade surface.

8. The cutting device as set forth in claim 6, in which a width of the cutting blade of the lower cutter is set according to a thickness of the lower cutter.

9. A cutting device for a compact printer, comprising:

a rotary type upper cutter mounted on an end of a cover and adapted to be laterally moved; and a lower cutter bent upwardly at a right angle along a longitudinal side to form a cutting blade to be engaged to the upper cutter, and having an arc-shaped seating protrusion at a location of its longitudinal side on which the upper cutter is seated, the lower cutter having biasing means for elastically supporting the lower cutter.

* * * * *